US006748700B1

(12) United States Patent
McAllister

(10) Patent No.: US 6,748,700 B1
(45) Date of Patent: Jun. 15, 2004

(54) SMOKE RELEASE AND VENTILATION SYSTEM

(75) Inventor: James Francis McAllister, Morpeth (GB)

(73) Assignee: Pensher Security Doors LTD (GB)

( * ) Notice: Subject to any disclaimer, the term of this patent is extended or adjusted under 35 U.S.C. 154(b) by 0 days.

(21) Appl. No.: 10/291,439

(22) Filed: Nov. 12, 2002

(51) Int. Cl.[7] ..... E05C 7/06
(52) U.S. Cl. ..... 49/119; 49/7; 49/95
(58) Field of Search ..... 49/1, 5, 6, 7, 31, 49/73, 95, 116, 119

(56) References Cited

U.S. PATENT DOCUMENTS

| | | | | | |
|---|---|---|---|---|---|
| 1,021,492 | A | * | 3/1912 | Strauss | 49/119 |
| 1,418,550 | A | * | 6/1922 | Fentress | 49/119 |
| 2,551,657 | A | | 5/1951 | Chambers | |
| 2,766,492 | A | | 10/1956 | Day et al. | |
| 2,791,420 | A | * | 5/1957 | Provost | 49/119 |
| 5,791,086 | A | * | 8/1998 | Huang | 49/7 |

FOREIGN PATENT DOCUMENTS

| | | |
|---|---|---|
| GB | 1 326 113 | 8/1973 |
| GB | 2 088 944 | 6/1982 |
| GB | 2 124 295 | 2/1984 |
| GB | 2 237 738 | 5/1991 |
| WO | WO-84/03534 | 9/1984 |

* cited by examiner

*Primary Examiner*—Jerry Redman
(74) *Attorney, Agent, or Firm*—Stites & Harbison PLLC,; Marvin Petry

(57) ABSTRACT

A smoke release and ventilation system comprises a frame housing upper and lower members each slidable in the frame between a normally closed position and an open position, the upper member being retained in its upper position by retaining element, for example an electromagnetic, the upper member being heavier than the lower member whereby, on release of the retaining, the upper member falls under gravity to its open position, and, consequential upon said fall of the upper member and the kinetic energy thereof, the lower member is raised to its open position, thereby providing gaps above and below the members and through which smoke can escape.

10 Claims, 3 Drawing Sheets

SMOKE RELEASE AND VENTILATION SYSTEM

BACKGROUND OF THE INVENTION

This invention relates to a smoke release and ventilation system, for example a smoke release and ventilation window.

When a fire breaks out in a building, the effect of the smoke and toxic fumes can be just as hazardous and life threatening to people as the fire itself. Therefore it is essential that a smoke filled area is ventilated in some way, to allow fresh air in and also to expel the smoke as quickly as possible, until the occupants can escape from the building safely.

There are products available for ventilating buildings when a fire breaks out. These devices are normally fixed to the window and usually have a motor to drive a mechanical device to open the window. Springs with fusible links are another method used to open a window when a fire breaks out.

The problem with these devices is that, if one part fails, then the window may not open when a fire breaks out. This could have a disastrous effect on the occupants of the building.

It would be desirable to be able to provide a reliable fail-safe system that would ensure ventilation and smoke release in the event that a fire broke out in a building.

According to the present invention there is provided a smoke release and ventilation system comprising a frame, upper and lower members within the frame each guided for movement between a normally closed and an open position, and retaining means for retaining the upper member in its closed position, the upper member being heavier than the lower member whereby, on release of the retaining means, the upper member falls under gravity to its open position, the kinetic energy of the upper member during falling thereof being sufficient to raise the lower member to its open position.

In a preferred embodiment of the invention, there are top and bottom vertically slidable windows of which the top window is held in the shut or closed position by an electromagnet powered by low voltage electricity. If a fire breaks out, the electricity supply is cut off via a smoke detector or heat sensor connected to the electromagnet. This de-energises the electromagnet, releasing the top vertically sliding window which is heavier than the bottom window and is connected to the bottom vertically sliding window via a cogged wheel and cogged rack or bar. As the top vertically sliding window falls, the bottom vertically sliding window rises up until the window hits a stop. This would leave open air gaps between the top vertically sliding window and the window frame, and between the bottom vertically sliding window and the window frame, allowing fresh air in the bottom gap and smoke out of the top gap. This system would be fail safe.

DESCRIPTION OF THE PREFERRED EMBODIMENT

Figure 1:
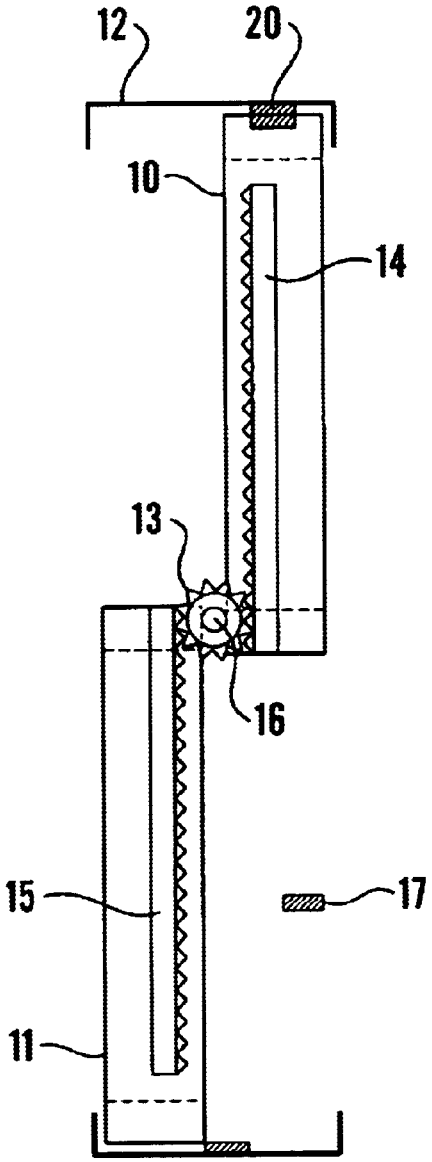
FIG. 1 shows an end view of a window frame and top and bottom vertically sliding windows in the closed position of a system according to the invention.

Referring to the drawings, the window comprises an outer window frame 12 and top and bottom vertically sliding windows 10, 11 held in the closed position by an electromagnet 20 when energised.

When the electromagnet 20 is de-energised, the top vertically sliding window 10 will fall under gravity and at the same time will raise the bottom vertically sliding window 11 until a stop 17 fixed to the window frame prevents both vertically sliding windows 10, 11 from moving past the desired point. It is possible to apply the invention to a frame/windows of wood, UPVC, aluminium, mild steel, stainless steel or other suitable material.

FIG. 1 shows the window frame 12 and the top and bottom vertically sliding windows 10, 11 mounted in the window frame 12 in the closed position. Attached to the top and bottom vertically sliding windows 10, 11 are cogged racks or bars 14, 15 which are meshed with a cogged wheel 13 secured to window frame 12 with a pin 16, allowing the cogged wheel 13 to rotate freely in a clockwise direction or an anti-clockwise direction. A cogged rack or bar 14 is meshed with cogged wheel 13 at the bottom of vertically sliding window 10, while a cogged rack or bar 15 is meshed with cogged wheel 13 at the top of vertically sliding window 11.

Both vertically sliding windows 10, 11 are held in the closed position by an electromagnet 20 when it is energised as in FIG. 1.

Figure 2:
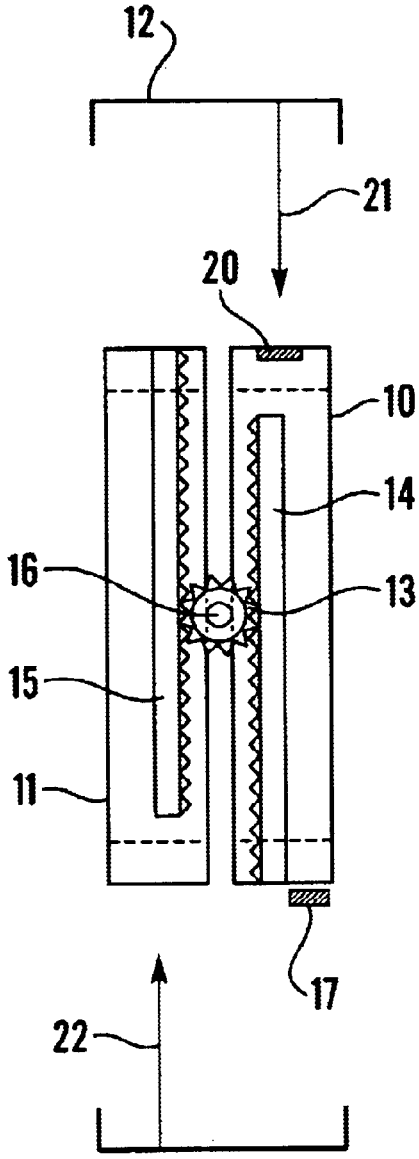
FIG. 2 shows an end view of the window frame and top and bottom vertically sliding windows of FIG. 1 in the open position.

When the electromagnet 20 is de-energised as in FIG. 2, the top vertically sliding window 10, which is heavier than the bottom vertically sliding window 11, will move down (arrow 21) to the lower position and hit the stop 17 as illustrated in FIG. 2.

As the top vertically sliding window 10 is moving down (arrow 21) to its lower position, the bottom vertically sliding window 11 will rise up (arrow 22) when cogged wheel 13 rotates, as it is meshed with cogged rack or bar 15. The vertically sliding windows 10, 11 are then in their open positions as in FIG. 2. The gap 23 at the bottom of window frame 12 (FIG. 2), will allow fresh air into the building, and the gap 24 at the top of window frame 12 (FIG. 2) will allow smoke to escape from the building.

Figure 3:
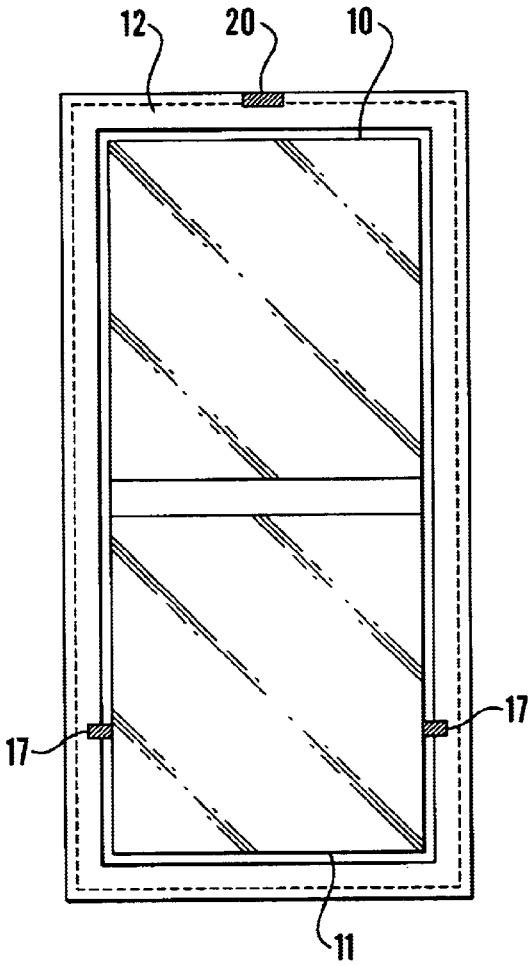
FIG. 3 shows a front view of the window frame and top and bottom vertically sliding windows of FIG. 1 in the closed position.

FIG. 3 shows a front view of window frame 12 and the vertically sliding windows 10, 11 in the closed position, held closed by the electromagnet 20.

Figure 4:
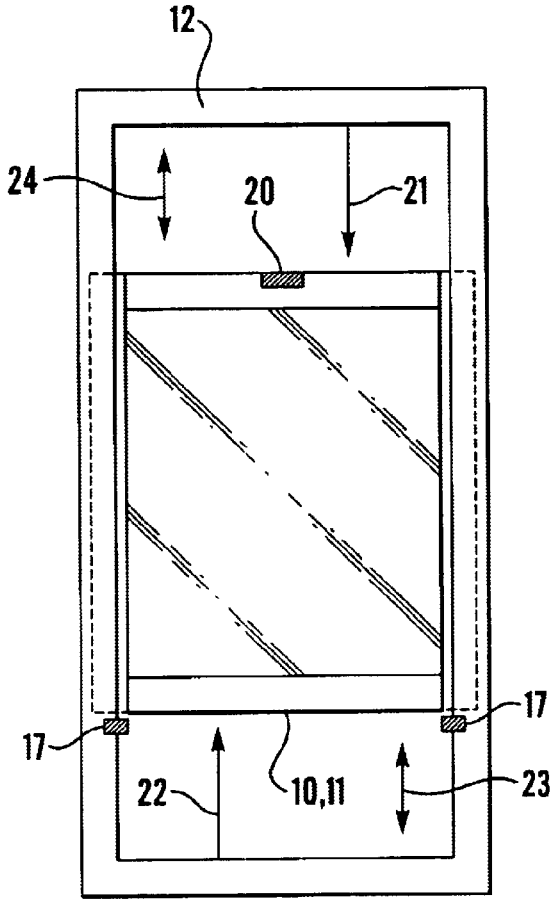
FIG. 4 shows a front view of the window frame and top and bottom vertically sliding windows of FIG. 1 in the open position.

FIG. 4 shows a front view of window frame 12 and vertically sliding windows 10, 11 in the open position leaving gaps 23, 24 at the top and bottom of the window frame 12.

Figure 5:
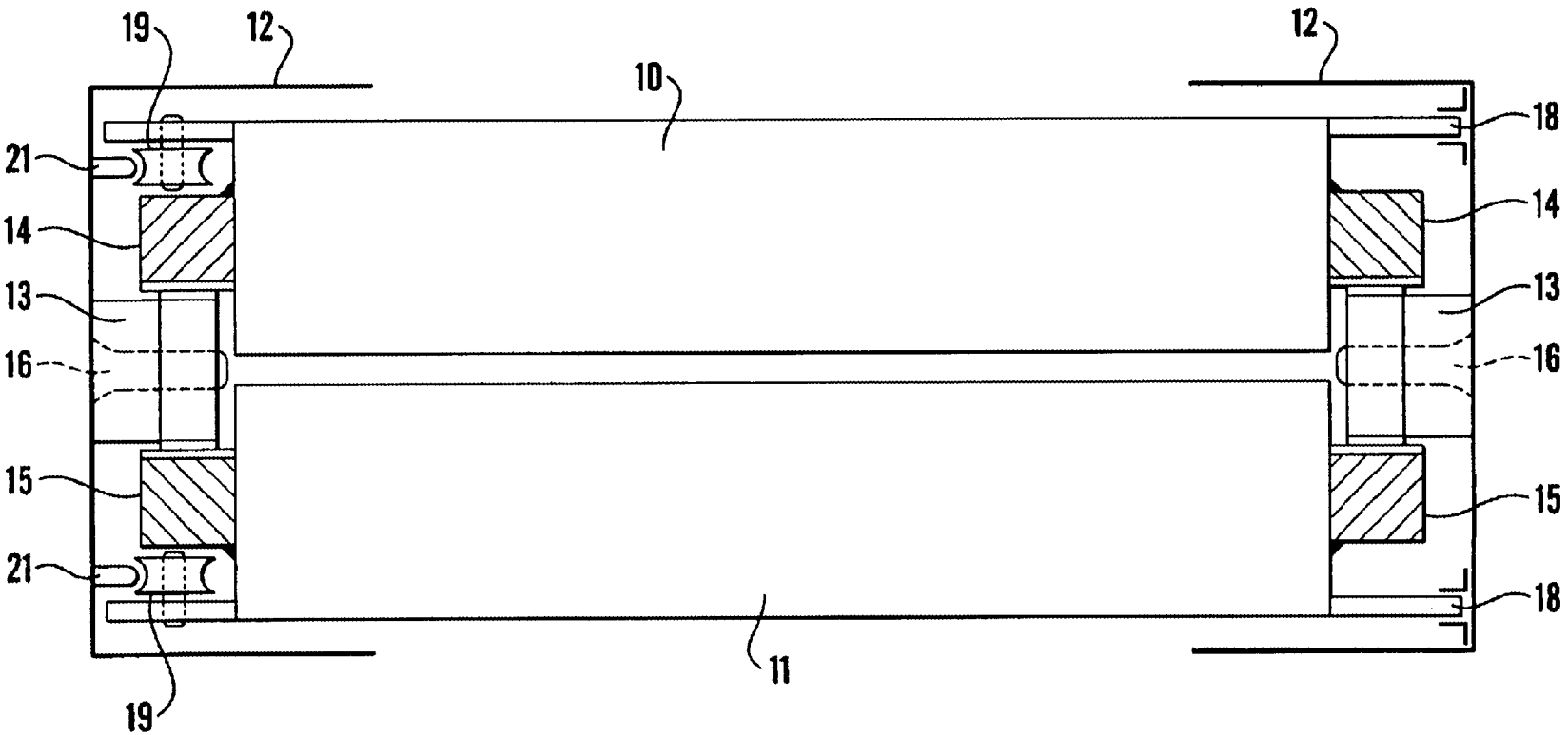
FIG. 5 shows a plan view of the window frame, top and bottom vertically sliding windows, cogged wheels, pins, cogged rack or bars, slides, runners and wheels of a system according to the invention.

FIG. 5 shows a plan view of the window frame 12. The vertically sliding windows 10, 11 are shown either side of the window frame 12. The cogged wheels 13 are shown either side of the window frame 12. The cogged wheels 13 are held in position by pins 16 which are fixed to window frame 12. The cogged racks or bars 14, 15 are shown fixed either side of the vertically sliding windows 10, 11. The vertically sliding windows 10, 11 are held in position within the window frame 12 either by slides 18 or rollers and guides 19, 21 (FIG. 5). These slides 18 or rollers and guides 19, 21 are there to allow both top and bottom vertically sliding windows 10, 11 to slide evenly and smoothly up and down inside the window frame 12.

Although described as a window, the system of the invention could incorporate opaque panels in place of windows 10, 11.

Retaining means other than an electromagnet may be used to hold the upper and lower windows/panels in the closed position, such as a heat sensitive link, for example a fusible link.

Other modifications and variations to the described and illustrated arrangements will be apparent to those skilled in the art.

What I claim and desire to secure by Letters Patent is:

1. A smoke release and ventilation system comprising a frame, upper and lower members within the frame each guided for movement between a normally closed and an open position, and retaining means retaining the upper member in its closed position, the upper member being heavier than the lower member, and upon release of the retaining means, the upper member falls under gravity to its open position, the kinetic energy of the upper member during falling thereof being sufficient to raise the lower member to its open position.

2. A system as claimed in claim 1 in which the retaining means are electrically operated.

3. A system as claimed in claim 2 in which the retaining means comprise an electromagnet components of which are mounted one on the frame and one on the upper member.

4. A system as claimed in claim 1 in which the retaining means comprise a heat sensitive link reacting between the frame and the upper member.

5. A system as claimed in claim 4 in which the heat sensitive link is a fusible member.

6. A system as claimed in claim 1 and comprising stop means on the frame with which the upper member abuts to determine the open position of the upper member.

7. A system as claimed in claim 1 and including drive means reacting between the upper and lower members whereby downward movement of the upper member is translated into upward movement of the lower member.

8. A system as claimed in claim 7 in which the drive means comprise a cogged wheel rotatable about a fixed axis extending transversely of the frame, and a pair of cogged racks, one attached to each of the upper and lower members, to mesh with opposed sides of said cogged wheel whereby, on downward movement of the upper member, the rack on the upper member rotates the wheel, said rotation of the wheel raising the rack on the lower member, and thereby raising the lower member.

9. A system as claimed in claim 8 in which the drive means comprises two cogged wheels, one to each side of the frame, the upper and lower members each carrying two cogged racks, one to each side thereof for co-operation with the associated cogged wheel.

10. A system as claimed in claim 1 in which the frame is a window frame and the upper and lower members are window members.

* * * * *